US006857526B2

(12) United States Patent
Vollmer

(10) Patent No.: US 6,857,526 B2
(45) Date of Patent: Feb. 22, 2005

(54) REVOLUTIONARY TOOTHBRUSH HOLDER

(76) Inventor: Eric John Vollmer, 1061 E. 8$^{TH}$ St., Chico, CA (US) 95928

( * ) Notice: Subject to any disclaimer, the term of this patent is extended or adjusted under 35 U.S.C. 154(b) by 0 days.

(21) Appl. No.: 09/915,523

(22) Filed: Jul. 27, 2001

(65) Prior Publication Data

US 2003/0024890 A1 Feb. 6, 2003

(51) Int. Cl.$^{7}$ ..... A47B 81/02
(52) U.S. Cl. ..... 211/65; 211/66; 248/110
(58) Field of Search ..... 211/66, 65, 87.01, 211/70.6; D6/528; 248/110

(56) References Cited

U.S. PATENT DOCUMENTS

| | | | | | |
|---|---|---|---|---|---|
| 67,120 | A | * | 7/1867 | Jedamski | 211/69.8 |
| 73,448 | A | * | 1/1868 | Keep | 211/69.8 |
| 1,669,143 | A | * | 5/1928 | Pocock | 206/362.1 |
| 2,917,182 | A | * | 12/1959 | Browne | 211/65 |
| 2,937,910 | A | * | 5/1960 | Randa | 312/207 |
| 3,138,414 | A | * | 6/1964 | La Pollo | 312/207 |
| 3,217,891 | A | * | 11/1965 | Weaver | 211/60.1 |
| 3,762,570 | A | * | 10/1973 | Tobin | 211/85.3 |
| 3,977,743 | A | * | 8/1976 | Harris | 312/207 |
| 4,325,485 | A | * | 4/1982 | Pina et al. | 211/66 |
| 4,566,597 | A | * | 1/1986 | Caputo et al. | 211/65 |
| 4,678,150 | A | * | 7/1987 | Newman et al. | 248/205.3 |
| 4,854,457 | A | * | 8/1989 | Perler | 211/65 |
| 4,973,262 | A | * | 11/1990 | Gerke et al. | 439/395 |
| 5,035,385 | A | * | 7/1991 | Markham | 248/108 |
| 5,097,966 | A | * | 3/1992 | Miller | 211/87.01 |
| 5,145,135 | A | * | 9/1992 | Thompson | 248/201 |
| 5,154,380 | A | * | 10/1992 | Risca | 248/154 |
| 5,163,566 | A | * | 11/1992 | Hempel | 211/65 |
| 5,259,519 | A | * | 11/1993 | Lieberman | 211/66 |
| 5,566,842 | A | * | 10/1996 | Dennis | 211/87.01 |
| 5,573,019 | A | * | 11/1996 | Hempel | 132/310 |
| 5,640,743 | A | * | 6/1997 | Greene et al. | 24/10 R |
| 5,669,515 | A | * | 9/1997 | Tisbo et al. | 211/70.6 |
| 5,727,698 | A | * | 3/1998 | Lai | 211/87.01 |
| 5,799,910 | A | * | 9/1998 | Dexter | 248/109 |
| 6,056,159 | A | * | 5/2000 | Layer | 22/105 |
| 6,119,854 | A | * | 9/2000 | Prentice et al. | 206/209.1 |
| 6,241,203 | B1 | * | 6/2001 | Cukrov | 248/110 |
| 6,300,568 | B1 | * | 10/2001 | Petri | 174/65 G |
| D451,731 | S | * | 12/2001 | Henderson | D6/534 |
| 6,345,015 | B1 | * | 2/2002 | Coulson | 368/10 |
| 6,364,165 | B2 | * | 4/2002 | Sampson et al. | 222/102 |
| 6,412,735 | B1 | * | 7/2002 | Mathieu | 248/110 |
| 6,513,773 | B1 | * | 2/2003 | Chang et al. | 248/231.91 |

* cited by examiner

*Primary Examiner*—Leslie A. Braun
*Assistant Examiner*—Khoa Tran

(57) ABSTRACT

A toothbrush holder comprising a polymer resin base and at least one pair of tapered receiving leads. The receiving leads are angled slightly upward in relation to the base, the toothbrush holder having an adhesive attachment strip on a backside thereof.

3 Claims, 1 Drawing Sheet

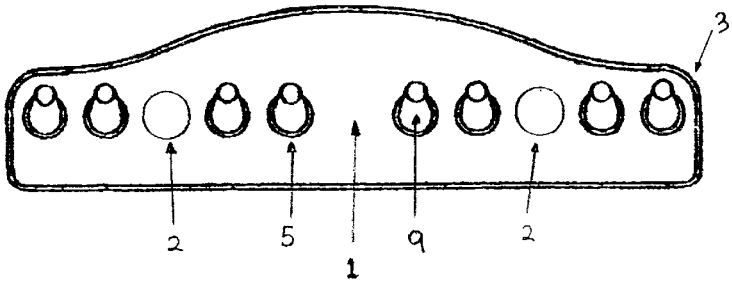
fig 1
fig 3
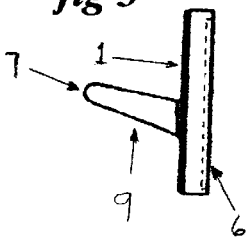
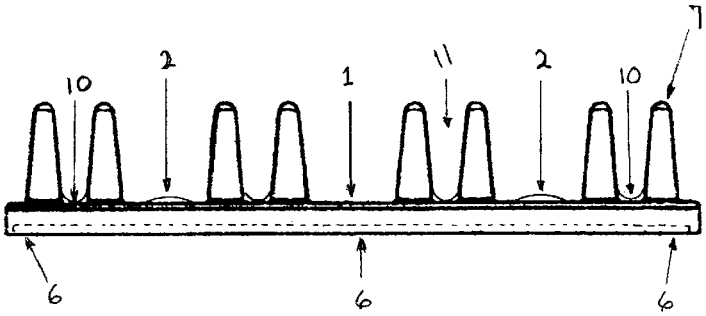
fig 2
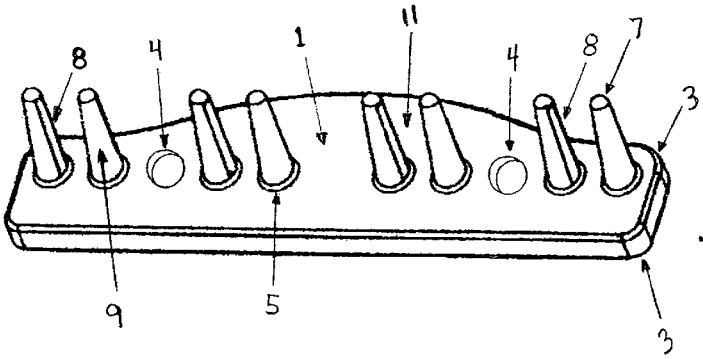
fig 4
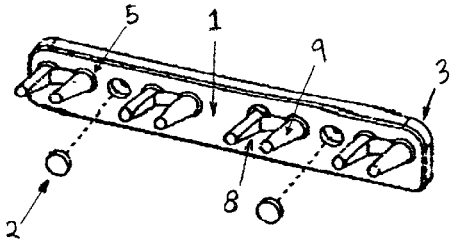
fig 5
fig 6
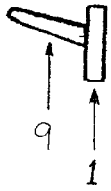

REVOLUTIONARY TOOTHBRUSH HOLDER

CROSS REFERENCE TO RELATED APPLICATIONS

| | | | |
|---|---|---|---|
| U.S. Pat. No. 5,609,259 | March 1995 | Menard | 211/66 |
| U.S. Pat. No. 3,946,877 | October 1974 | Galicia | 211/65 |
| U.S. Pat. No. 5,369,835 | December 1994 | Clark | 248/110 |
| U.S. Pat. No. D398,177 | January 1997 | Garcia | D6/534 |
| U.S. Pat. No. 5,573,019 | October 1994 | Hemple | 211/654 |
| U.S. Pat. No. 3,531,072 | September 1970 | Linquist | 248/113 |
| U.S. Pat. No. 4,854,457 | August 1998 | Perler | 211/65 |
| U.S. Pat. No. D320,123 | September 1991 | Wolf | D6/528 |
| U.S. Pat. No. D278,777 | May 1985 | Martin | D6/534 |

FIELD OF INVENTION

This invention relates to a holder for holding such devices as toothbrushes in a secure and sanitary manner.

BACKGROUND OF THE INVENTION

The configuration and design of the toothbrush has taken many forms since its conception. With the constant change and evolution of these said devices most toothbrush holders, prevalent in many homes, may not be able to accommodate the wide variety of new and changing designs.

With the newer designs of toothbrushes, offering a wide array of features, such as flexing handles, oversized bristles and heads, over molded handles with softer materials for comfort (some molded in recognizable shapes for children) are revolutionary ideas, subsequently most prior art toothbrush holders may not be able to accommodate them.

Traditional toothbrush holders, typically wall mounted, may be challenging for some to mount and are comprised of various ridged materials with a plurality of apertures for holding toothbrushes. These apertures typically sized to hold the traditional style toothbrush typically being of straight shaft and designed so that the handle is placed through the aperture and the bristles of the toothbrush would contact the surface of the holder as a stop feature. This contact with said bristles to holder promotes a possibility for contaminants or bacteria to contact the bristles of the toothbrush by way of the holder.

Other types of toothbrush holders are designed to set on a counter or shelf and are comprised of various ridged materials with a plurality of apertures facing upward from the base of the holder. These prior art designs require counter or shelf space to be functional and in many cases this space is not available. Also to locate a toothbrush, the handle portion may need to pass through an aperture to be located in the holder. This can be a problem for newer styles of toothbrushes where as the handle may be larger than the aperture. In addition, to retrieve the toothbrush from the holder the hand may make contact with the portion of the toothbrush that will most likely make contact with the mouth. This could promote an unsanitary condition if the hands are not washed prior to use.

Most prior art styles of toothbrush holders propose several challenges to holding the newer styles of toothbrush. With these challenges alternative practices are being comprised for holding toothbrushes, some in the form of a drinking cup as a toothbrush bolder to hold toothbrushes that no longer fit in prior art holders. This could promote an unsanitary condition due to the build up of paste, saliva, germs and also from multiple brushes coming in contact. Also if the cup was to get knocked over, and if made of breakable material, shards could get lodged into the bristles in addition to the contamination of the toothbrushes contacting an unsanitary surface.

Many prior art toothbrush holders have used C-shaped, T-shaped, U-shaped, L-shaped, circular, square, rectangular or elliptical shaped apertures in their configurations. However many such designs may not hold the newer style toothbrush in a secure and/or sanitary manner. In addition, some of the prior art designs are configured so that the toothbrush has to be loaded into the holder by placing it through an aperture and dropping it in and/or locating it in a said letter shaped slots. For some the locating and placement of a toothbrush in some prior art apertures requires using both hands and can be challenging, especially in children where as there dexterity has not fully developed.

In a number of prior art toothbrush holders the design and/or material used have left these holders hard to keep sanitary. Sharp corner areas and underneath surfaces are hard to clean and some container style holders (sometimes made of porous materials) would need to be soaked to be sanitized. Some prior art has addressed this by making disposable type holders. This proposes two concerns; cost of replacing the holder and contributing to disposable waste.

Some prior art toothbrush holders have addressed the sanitary issues such as Hemple U.S. Pat. No. 5,573,019 (1994). The holder arrests the toothbrush at the upper extremity of the handle and far enough below the bristles holding it in a secure and sanitary fashion. However, with the ever changing designs and styles of toothbrushes, such prior art holders may not be able to hold the newer styles of toothbrush.

Other prior art holders address accommodating a wide variety of newer style toothbrushes such as Menard U.S. Pat. No. 5,609,259 (1995). With this wall mount holder the toothbrush is directed into an above mentioned L-shaped slot and then further located into the final position area of the slot. This design holds a wide variety of toothbrushes securely. However, the ease of mounting and use of this holder may be challenging for some and with the L-shaped slots and underlying surface beneath the planer surface to the bristle area, this style of holder may be challenging to keep sanitary.

In addition, many prior art toothbrush holders need ample room for the holder to be used effectively in retrieving and replacing the toothbrush, as well as the space needed for the location of the holder. This could be a problem for the use of some prior art holders in areas where space is confined: such as motorhomes, marine vehicles and many residential homes.

With all the prior art designs and styles of toothbrush holders, the need for a holder that will accommodate the wide variety of ever changing and evolving designs of the toothbrush and hold them in a secure and sanitary manner that is easy to use and keep clean, still exists.

SUMMERY OF INVENTION

The invention is a toothbrush holder that consists of a plurality of apertures that are consistent in form and function. The conical leads of the apertures angle upward slightly in relation to the generally planer surface. The conical leads of the apertures are drafted to accept the toothbrush, and hold it in place. The conical leads that form the V-shaped aperture design is constructed to receive the neck portion of the toothbrush and hold it securely and in a manner that the bristles of the toothbrush do not rest on the holder.

The design is contoured so that there are no sharp corners or underlying surfaces. The invention is made of a durable, semi-flexible polymer resin, that when slight pressure is applied to the toothbrush in the aperture, the conical leads flex and the toothbrush will be held securely from vibration or accidental contact. The invention is designed to hold the toothbrush parallel to the mounting surface, holding the toothbrush in an upright or vertical position.

The object of the invention is to supply the user with an easy to use, easy to clean, easy to mount holder that keeps the bristles of the toothbrush from coming in contact with the holder and is aesthetically appealing.

It is also the object of the invention to hold a wide variety of designs and configurations of toothbrushes in a secure and sanitary manner.

It is also the object of the invention to be constructed with smooth contoured surfaces, so that the holder has no areas for bacteria to harbor and so that it may be easily cleaned.

It is also the object of the invention that the toothbrush be easily retrieved from the holder and easily reapplied back to the holder.

It is also the object of the invention that it needs minimal area to be mounted and used. Also that it can be mounted inside a makeup, medicine or other types of cabinet, or to the inner surface of the cabinet door.

It is also the object of the invention to be comprised of a durable semi-flexible polymer resin to allow the toothbrush to be depressed into the conical leads of the aperture holding it secure from vibration or accidental contact.

It is also the object of the invention that the conical leads (that form the aperture) flex slightly to receive the toothbrush and hold it in a secure and sanitary manner.

It is also the object of the invention that the toothbrush be able to be retrieved from the holder and put back easily with one hand by contact with the handle portion of the toothbrush solely.

It is also the object of the invention that the hand should never need to make contact with the bristle area of the toothbrush upon retrieving the toothbrush from or reapplying the toothbrush back to the holder.

BRIEF DESCRIPTION OF DRAWINGS

FIG. 1 is a front view of one configuration of the toothbrush holder.

FIG. 2 is a top view of one configuration of the toothbrush holder.

FIG. 3 is a side view of one configuration of the toothbrush holder.

FIG. 4 is a reference view of one configuration of the toothbrush holder.

FIG. 5 is a reference view of another configuration of the invention.

FIG. 6 is a side view of another configuration of the invention illustrated in FIG. S.

REFERENCE NUMERALS IN DRAWINGS

1 generally planar surface, contoured mounting surface or base

2 screw hole cover caps

3 radius corners

4 screw holes

5 radius contour of conical lead at base

6 recessed area for adhesive attachment strip

7 contoured radius tip of conical lead

8 inner flat contact surface on conical lead

9 conical lead/leads.

10 contour feature between conical leads

11 V-shaped aperture

DETAILED DESCRIPTION OF THE INVENTION

As illustrated in FIG. 3, the side view shows the slight upward angle of the 9, conical lead/leads of the aperture with 7, contoured radius tip. This is designed in to allow gravity to assist in the holding of the toothbrush, if by chance it is dislodged from its secure holding position; the angle is such that the toothbrush would have to defy gravity to exit the holder. The 7, contoured radius tip is designed for easy application of the toothbrush to the holder and to help guide the toothbrush into the 11, V-shaped aperture. This view also shows the 6, recessed area for adhesive strip. The angle design of the 9, conical leads are assistants to the location design to hold the toothbrush at the neck portion. This is the area between the head (where the bristles are located) and the handle (where the toothbrush is held). This neck portion of the toothbrush is typically the narrowest portion of the toothbrush and is somewhat consistent throughout the industry. Also shown is I, generally planar surface or contoured mounting surface or base.

As illustrated in FIG. 2, the top view shows one of the 10, contoured design features of the toothbrush holder with a plurality of 11, V-shaped apertures in consistency within the design. Consisting of at least one 11, V-shaped aperture with a pair of 9, conical leads tapering in towards the 1, base in a 11, V-shape to securely hold the toothbrush. Item 6 is again shown here as a recessed area for adhesive attachment strip. Also Shown is the 2, screw hole cover caps for aesthetics when optional screw mount capability is used.

As illustrated in FIG. 1, the front view shows one of the contoured aesthetic shapes and designs of the 1, base of the toothbrush holder with 3, radius corners and 5, radius contour at base of 9, conical lead. Also viewed are the 2, contoured (press fit) screw hole cover caps. The toothbrush holder can be mounted by either adhesive or by screws or both.

FIG. 4 is a reference view that shows the 8, inner flat contact surface area of the 9, conical lead. This adds more surface contact from the holder to the neck portion of the toothbrush. The 11, V-shape aperture with the 8 inner contact surface on the 9, conical lead is designed so that toothbrushes with larger necks are held towards the wider portion of the 11, V-shaped aperture and toothbrushes with smaller necks are held further in towards the narrowing portion of the 11, V-shaped aperture. And with the 9, conical leads able to flex, the toothbrush can be depressed or wedged in-between said 9, conical leads holding a vast range of toothbrushes with different neck sizes.

FIG. 5 is a reference drawing of a slim line configuration of the invention with FIG. 6 as the side view. All claims and details pertain to any and all configurations of the invention.

The design and construction of the invention is so that it will not rust, crack, chip, break, or lose its ability to hold the toothbrush securely for the life of the holder. The holder is designed for ease of use by means of locating and holding the toothbrush by the neck portion of the toothbrush. By this, the toothbrush can be applied to and retrieved from the toothbrush holder by way of the handle, further reducing the risk of contamination to the bristle portion of the toothbrush.

This new style toothbrush holder is designed so that the toothbrush may be placed between the conical leads of the aperture to be held in an upright sanitary manner or with slight pressure depressed into the aperture, flexing the conical leads, to hold it more securely. This ability to depress the toothbrush into the holder gives it a unique ability to securely hold a toothbrush in areas where vibration is present, such as motor homes or marine vessels.

The invention is designed so that it may be applied to any relatively smooth vertical surface, such as a wall, shelf unit or the door of a cabinet, as long as there is clearance for the length of the toothbrush. The back side of the invention is recessed to accept a means for attachment, so when mounted, is flush with mounting surface. Flush mount is achieved by either screws or adhesive.

The smooth rounded contoured design and nonporous surface finish of the invention is so that there are no sharp corners or underlying surfaces for bacteria or germs to easily harbor. Also so that the toothbrush holder is cosmetically appealing as well as easy to use and clean.

In addition, with this straightforward application from toothbrush to holder and easy mounting capability, this invention needs the very minimal amount of space to be fully functional.

What I claim as my invention is:

1. A toothbrush holder comprising a base and at least one pair of flexible conical-shaped receiving leads that slightly flex for receiving a toothbrush, said receiving leads angled slightly upward in relation to said base and defining a V-shaped aperture, each said receiving lead having a flat contact area along the length of said lead for receiving the neck portion of various sizes of said toothbrush and for holding the toothbrush securely in a manner such that the bristles of said toothbrush do not contact said toothbrush holder, said toothbrush holder having an adhesive attachment strip on a backside thereof.

2. The toothbrush holder of claim 1, wherein said backside is recessed to accept said adhesive attachment strip.

3. The toothbrush holder of claim 1, wherein said pair of flexible conical-shaped receiving leads defines a V-shaped aperture for receiving the neck portion of a toothbrush.

* * * * *